US011655691B2

(12) United States Patent
Henderson et al.

(10) Patent No.: US 11,655,691 B2
(45) Date of Patent: May 23, 2023

(54) DOWNHOLE CLEANING APPARATUS

(71) Applicant: Odfjell Technology Invest Ltd, Kokstad (NO)

(72) Inventors: Scott Henderson, Dubai (AE); Greg Rankin, Dubai (AE); Johnoson Dsouza, Dubai (AE)

(73) Assignee: Odfjell Technology Invest Ltd, Kokstad (NO)

( * ) Notice: Subject to any disclaimer, the term of this patent is extended or adjusted under 35 U.S.C. 154(b) by 0 days.

(21) Appl. No.: 16/967,410

(22) PCT Filed: Feb. 11, 2019

(86) PCT No.: PCT/EP2019/053345
§ 371 (c)(1),
(2) Date: Aug. 4, 2020

(87) PCT Pub. No.: WO2019/155074
PCT Pub. Date: Aug. 15, 2019

(65) Prior Publication Data

US 2021/0131230 A1 May 6, 2021

(30) Foreign Application Priority Data

Feb. 12, 2018 (GB) ..... 1802223

(51) Int. Cl.
*E21B 37/04* (2006.01)

(52) U.S. Cl.
CPC ..... *E21B 37/04* (2013.01)

(58) Field of Classification Search
CPC ..... E21B 37/02; E21B 37/04; E21B 37/045
See application file for complete search history.

(56) References Cited

U.S. PATENT DOCUMENTS 2,811,210 A 10/1957 Guillot
2,857,141 A * 10/1958 Carpenter ..... E21B 37/02 166/174

(Continued)

FOREIGN PATENT DOCUMENTS

CN 2521386 Y 11/2002
CN 204571937 U 8/2015

(Continued)

OTHER PUBLICATIONS

Office Action dated Sep. 2, 2020 in related Japanese Application No. 2020-002544 and English Translation.

(Continued)

*Primary Examiner* — David Carroll
(74) *Attorney, Agent, or Firm* — Wright IP & International Law; Eric G. Wright

(57) ABSTRACT

Disclosed herein is a downhole cleaning apparatus and a method of cleaning a wellbore. The downhole cleaning apparatus has a body and a cleaning element coupled to the body. The cleaning element is selectively moveable in relation to the body from a retracted position to an extended position. When the cleaning element is in the retracted position it is retained by retention formations internal to the tool that are coupled together. The retention formations can be slideably released from one another to enable the cleaning element is able to move to the extended position. The force required to slideable release the retention formations exceeds any forces encountered when the apparatus is run in, preventing premature extension of the cleaning element.

21 Claims, 6 Drawing Sheets

(56) References Cited

U.S. PATENT DOCUMENTS

| | | | | |
|---|---|---|---|---|
| 4,421,182 | A | 12/1983 | Moody et al. | |
| 4,452,307 | A | 6/1984 | Horton | |
| 4,809,779 | A | 3/1989 | Ledyashov et al. | |
| 5,819,353 | A | 10/1998 | Armell et al. | |
| 6,152,221 | A | 11/2000 | Carmichael et al. | |
| 6,182,754 | B1 | 2/2001 | Vermeeren | |
| 6,401,813 | B1 | 6/2002 | Carmichael et al. | |
| 10,526,871 | B2 | 1/2020 | Tzallas et al. | |
| 2001/0022223 | A1 | 9/2001 | Howlett | |
| 2002/0104649 | A1 | 8/2002 | Allen | |
| 2005/0056429 | A1 | 3/2005 | Du et al. | |
| 2005/0168834 | A1 | 8/2005 | Matsumoto et al. | |
| 2005/0241856 | A1* | 11/2005 | Lassoie | E21B 10/322 175/57 |
| 2007/0095573 | A1 | 5/2007 | Telfer | |
| 2009/0025927 | A1* | 1/2009 | Telfer | E21B 37/04 166/174 |
| 2009/0169319 | A1 | 7/2009 | Hart | |
| 2009/0174955 | A1 | 7/2009 | Ishimoda et al. | |
| 2009/0218092 | A1* | 9/2009 | Booth | E21B 37/02 166/174 |
| 2010/0243257 | A1 | 9/2010 | Krieg et al. | |
| 2011/0186355 | A1* | 8/2011 | Telfer | E21B 37/02 175/84 |
| 2011/0214873 | A1* | 9/2011 | Krieg | E21B 37/00 166/174 |
| 2011/0284233 | A1 | 11/2011 | Wu et al. | |
| 2013/0192818 | A1 | 8/2013 | Winn et al. | |
| 2013/0205523 | A1 | 8/2013 | Palmer | |
| 2013/0248249 | A1 | 9/2013 | Xu | |
| 2014/0116712 | A1 | 5/2014 | Bansal et al. | |
| 2015/0027713 | A1 | 1/2015 | Penisson | |
| 2015/0027780 | A1 | 1/2015 | Hern et al. | |
| 2015/0114665 | A1 | 4/2015 | Hora et al. | |

FOREIGN PATENT DOCUMENTS

| | | | |
|---|---|---|---|
| CN | 205591887 | U | 9/2016 |
| CN | 205823237 | U | 12/2016 |
| GB | 2336612 | A | 10/1999 |
| GB | 2411919 | A | 9/2005 |
| GB | 2411920 | A | 9/2005 |
| JP | 2004-133053 | | 4/2004 |
| JP | 2009-163100 | | 7/2009 |
| WO | 9954590 | A1 | 10/1999 |
| WO | 0107752 | | 2/2001 |
| WO | 0235055 | A1 | 5/2002 |
| WO | 03087526 | A1 | 10/2003 |
| WO | 2004022907 | A1 | 3/2004 |
| WO | 2004067908 | A1 | 8/2004 |
| WO | 2004088091 | A1 | 10/2004 |
| WO | 2006016102 | A1 | 2/2006 |
| WO | 2007003894 | A2 | 1/2007 |
| WO | 2010015861 | A2 | 2/2010 |
| WO | 2010048167 | A2 | 4/2010 |
| WO | 2015150212 | A2 | 10/2015 |

OTHER PUBLICATIONS

International Search Report, PCT/EP2019/053345, EPO (dated Jul. 1, 2019).

Patents Act 1977: Search Report Under Section 17, GB1802223.6 IPO (dated Jun. 22, 2018).

International Search Report, PCT/EP2015/056540, EPO (dated Jan. 15, 2016).

Patents Act 1977: Search Report Under Section 17(5), GB1509015.2, IPO (dated Sep. 8, 2015).

Patents Act 1977: Search Report Under Section 17(5), GB1405967.9, IPO (dated Sep. 23, 2014).

* cited by examiner

DOWNHOLE CLEANING APPARATUS

CROSS-REFERENCE TO RELATED APPLICATIONS

This application is a US National Stage Application of PCT/EP2019/053345 filed Feb. 11, 2019, titled "Downhole Cleaning Apparatus" and claims foreign priority to GB 1802223.6 filed Feb. 12, 2018 which is titled "Downhole Cleaning Apparatus".

INCORPORATION BY REFERENCE

This patent application incorporates by reference in its entirety patent application GB 1802223.6 filed Feb. 12, 2018, titled "Downhole Cleaning Apparatus" to which foreign priority is claimed.

FIELD OF INVENTION

The present invention relates to well cleaning. In particular, the present invention relates to cleaning apparatus operable to clean a well casing to remove unwanted material and debris from the interior surface of a well casing.

BACKGROUND TO THE INVENTION

When an oil and gas well is drilled, it is common to clean the wellbore after primary activities are completed. The wellbore cleaning can be carried out during a designated clean up run or on the same run as the primary activity. The cleaning apparatus can take various forms and serve various functions, however they share some common features such as cleaning elements that engage with wellbore; these include but are not limited to blades, wipers or pads.

In some circumstances, it is desirable for cleaning apparatus, such as a cleaning tool, to be run into a well in an inactive condition in which the cleaning elements do not contact with the bore, and for the apparatus to be selectively "activated", i.e. so that the cleaning elements can be used to clean the wellbore. Typically, this requires the cleaning elements to be held in a retracted position until required for use and then extended when required.

One such apparatus is described in WO 2015/150212 of Odfjell Partners Invest Ltd, in which a helical array of cleaning elements are held within the tool body by a series of shear pins, actuated by a sliding sleeve. The tool can be activated using a ball or dart to block the internal bore of the tool, and internal fluid pressure varied so as to first set the sleeve, then activate the cleaning elements and then re-open the bore of the tool to allow fluid to flow during a cleaning operation.

In some applications, however, activation mechanisms based on shear pins are prone to failure or can be prematurely activated, for example due to metal fatigue in the pins or shearing due to g-forces and axial forces transmitted to or through the tool, for example as the tool is run into a well or during a primary operation such as drilling. These problems may be particularly acute for example in deviated wells or unlined wells.

In use of there remains a need to more reliably deploy such cleaning apparatus.

SUMMARY OF INVENTION

According to a first aspect of the present invention there is provided a downhole cleaning apparatus comprising:

a body and a cleaning element coupled to the body;

the cleaning element selectively moveable in relation to the body from a retracted position to an extended position; and the cleaning element having an inner portion comprising a first retention formation and an outer portion comprising a cleaning formation; and an actuation system comprising a second retention formation slideable in relation to the body between a retaining position and a release position;

wherein, in the retracted position, the first retention formation is coupled to the second retention formation; the first and second retention formations being slideably releasable from one another by sliding the second retention formation from the retaining position to the release position, in which the cleaning element is able to move to the extended position.

The force required to move the second retention formation can thereby be selected to exceed or greatly exceed any forces that the downhole cleaning apparatus might encounter when being run in or during primary operations, such as drilling, thereby preventing premature extension of the cleaning element.

The inner portion of the cleaning element referred to herein defines those surfaces or regions of the cleaning element which are not, in use, exposed to the well bore or tubular to be cleaned. The outer portion of the cleaning element includes those surfaces or regions of the cleaning element which are exposed in use, at least in the extended position.

Location of the first retention formation on the inner portion of the cleaning element prevents contact with debris, that might otherwise interfere with of the tool (for example the movement of the cleaning element from retracted to extended positions, the operation of the actuation system interacting with the first retention formation etc).

The actuation system may be operable to selectively move the cleaning element, or to facilitate selective movement of the cleaning element.

The body may be tubular. The body may define a through bore.

The second retention formation may be slideable along an axis (e.g. a longitudinal axis extending through the body or along a work string) or rotatable around an axis, between the retaining and release positions.

The second retention formation can be locked in the retaining position, and/or the second retention formation can be biased towards the retaining position.

In the retracted position, the cleaning element is in use spaced apart from a wellbore. For example, the retracted cleaning element may be stored in, or recessed into or flush with an outer surface of the body.

In the extended position, the cleaning element is in use extended from the body so that the cleaning formation can engage with a wellbore. For example, when extended, the cleaning formation extend radially beyond an outer surface of the body.

When the second retention formation is in the retaining position, the second retention formation and/or another moveable component of the actuation system, may be locked by a shear element (e.g. a shear pin or pins or a shear ring).

The second retention formation can be biased towards the retaining position by a resilient biasing arrangement, such as a spring or springs which act (directly or indirectly) between the body and the second retention formation.

The first and second retention formations may cooperatively engage with one another, in the retracted position.

The first and second formations may function as a latch, to latch the cleaning element in the retracted position.

The first retention formation may comprise a protrusion from the cleaning element and the second retention formation may comprise a recess or aperture sized to receive at least a part of the first retention formation. The actuation system may comprise said recess.

The first retention formation may extend from an inner face (of the inner portion) of the cleaning element; that is to say a face of the cleaning element oriented away from the cleaning formations and so typically oriented generally radially inwards.

The second retention formation may be set into an outer surface of a part of the actuation system, such as a setting sleeve.

Alternatively, the first retention formation may comprise a recess, and the second retention formation may comprise a protrusion from the actuation system or a part thereof. The second retention formation may extend from an outer face of a part of the actuation system, and the first retention formation may be set into an inner surface of the cleaning element. A recess of a said retention formation may have an entranceway and an enclosed region extending therefrom. The enclosed region may be enclosed by a lip extending partially across the recess. The cleaning element may be retained from moving radially outwardly by engagement of a radially outward surface of a said first or second retention formation (as the case may be) with the radially inner surface of the lip.

A protrusion of a said retention formation may have a radially extending portion (corresponding for example to the depth of the recess) and a circumferentially and/or longitudinally extending portion (for example sized to be received, in said enclosed region of the recess).

A said protrusion may be generally L-shaped in cross section (in a direction of motion between the retaining and release positions).

Other interlocking retentions are also envisaged, such as tapered wedges, pegs/holes and/or formations adapted to be slideably moved out of engagement with one another.

The actuation system may comprise a setting sleeve, or a portion thereof. The setting sleeve may comprise the second retention formation. An outer facing surface of the setting sleeve may comprise the second retention formation. The sleeve may be operatively coupled to the second retention formation (e.g. such that movement of the sleeve moves or enables the second retention formation to be moved). The sleeve may be moveable into engagement with the second retention formation, so that further movement of the sleeve may effect movement of the second retention formation.

The sleeve may be axially rotatable and/or longitudinally moveable in relation to the body, wherein such longitudinal or rotational motion slideably moves the second retention formation in relation to the first retention formation.

The sleeve may be slideable within the body.

The sleeve may be guided along a path, defined for example by a pin extending from the sleeve or body, running within a track in the other of the sleeve or body. The body and the setting sleeve may each comprise an angular profile such that movement of the sleeve relative to the tubing body is guided.

The setting sleeve may be activated by a mechanical trigger, electronic signal or applied fluid pressure.

The second retention formation may comprise a recess in the sleeve or a protrusion therefrom.

At least a part of the first and/or second retention formations may be annular or part-annular.

The cleaning element may comprise two or more first retention formations (of the same or different types). The actuation system may comprise two or more second retention formations (of the same or different types) associated with the cleaning element.

The cleaning element may be retractable or selectively retractable. That is to say, the cleaning element may be (selectively) moveable in relation to the body from the extended position to the retracted position.

The cleaning element may be re-settable, in the retracted position. For example, after use, the tool may be recovered and the cleaning element urged into a retracted position and the actuation system re-set.

The cleaning element may in some embodiments be selectively retractable in use downhole.

Moving the second retention formation from the release position to the retaining position may cause the cleaning element to move from the extended position to the retracted position. This may be achieved for example by way of a first and/or or a second retention formation having a ramped surface.

The cleaning element may be biased towards the extended position. For example, a biasing member such as a spring or elastomer (or two or biasing members) may act between the cleaning element and the body. A biasing member may act directly between the cleaning element and the body.

A biasing force may be provided between magnetic elements.

A said biasing member of force may act between the cleaning element (for example an inner surface thereof) and a part of the actuation system (such as an adjacent outer surface thereof), for example a setting sleeve.

A cleaning element biased in this way may, in the extended position, be capable of moving radially inward to some degree in use, to accommodate the dimensions of a tubular or wellbore to be cleaned. The first and second retaining formations, being released from one another, do not interfere with such movement of the cleaning element in this way.

The biasing member may be resiliently deformed (e.g. compressed) when the cleaning element is in the retracted position, so as to urge the cleaning member towards the extended position, when the second retention formation is in the release position.

The cleaning element may in some embodiments be unbiased, at least in the retracted position and with the second retention formation in the retaining position. For example, a biasing element may be compressed or otherwise primed by moving the second retention formation to the release position.

The cleaning element may be biased towards the retracted position. Such a cleaning element may be extendable under the action of fluid pressure, and/or may be mechanically extendable, for example under the action of a slideable wedge or ramp acting between the cleaning element and the body.

A mechanical trigger, electronic signal or fluid pressure may move the cleaning element from retracted to extended. A magnetic force may move the cleaning element from retracted to extended. The cleaning element may comprise a magnetic element (e.g. a permanent magnet) and a further magnetic element may be coupled to the body (directly or indirectly).

In some embodiments, movement of the second retaining formation, or another operation of the actuation system, may bring the magnetic element of the cleaning element into proximity with a magnetic element of the actuation system (e.g. mounted to a said setting sleeve), whereby repulsion between said magnetic elements urges the cleaning element towards the extended positon.

The cleaning element may be retained in the retracted position by the actuation system until required for use. The actuation system may be operable to at least "prime" the cleaning elements for movement from a retracted position to an extended position, by causing the second retention formation to move to the release position. For example, once the second retention formation is in the release position, a further action or action may be required to move the cleaning element to the extended position—such as an increase in the fluid pressure within the body, compression of the drill string, operation of an extension mechanism or further operation of the actuation system (e.g. to bring a slideable sleeve or wedge to bear upon the cleaning element, adapted to urge the cleaning element outwardly) or the like.

In use, the actuation system may comprise one or more stages of operation, wherein one or more of the following may be applied: a mechanical trigger, an electronic signal and an applied fluid pressure. Where a plurality of operation stages is utilised each stage may be activated sequentially such that a change of position of the cleaning element from retracted to extended (and, in some embodiments, from extended to retracted) is controllable in a predictable manner.

The actuation system may comprise one or more of the following: a ball; a dart.

The ball or dart may, when released into the body, come to rest in a seat. A through bore may thereby be at least partially blocked to facilitate an increase of internal pressure within the body, the increase in pressure causing the second retention formation to move from the retaining position to the release position.

The increase in pressure may be used to break or shear at least one shear element such that the actuation system can be operated to move the second retention formation.

Alternatively, or in addition, the increase in pressure may be used to overcome the force of a said resilient biasing arrangement.

The ball or dart may be released by a mechanical trigger, electronic signal or applied fluid pressure.

The ball may be made from a deformable material.

The seat may be configured to allow the ball or dart to pass through. The seat may be deformable under pressure. The seat may comprise a collet. The collet may comprise expanding jaws or dogs, which are displaceable thereby allowing the dart or ball to pass through.

The seat may be coupled to the second retention formation, e.g. to a said setting sleeve, so that forces applied to the seat are transmitted to the second retention formation.

The actuation system may alternatively be operable by compressing the cleaning apparatus.

For example, a setting sleeve may be longitudinally slideable in relation to the body and biased to abut the body at an end of its range of motion (which may correspond to the second retention element being in the retention position). Compression of the cleaning apparatus may compress the body and thereby move the sleeve.

The body may comprise first and second body portions longitudinally moveable in relation to one another, to facilitate such compressive operation.

Alternatively, or in addition, further action may be required for the actuation system to effect motion of the second retention formation between the retaining and release positions. For example, a setting sleeve may be moved in a first action into operative engagement with the second retention formation, and in a second action the setting sleeve may be moved so as to move the second retention formation. The first action may be axial. The second action may be rotational.

The further movement of the setting sleeve or ball may be activated by a mechanical trigger, electronic signal or applied fluid pressure.

The cleaning element comprises a cutting profile operable, in use, by axial and/or rotational reciprocation to remove debris from a surface in which the cleaning elements are in contact.

The apparatus may comprise two, or three, or a plurality of cleaning elements. The cleaning elements may be symmetrically disposed around a longitudinal axis through the body. For example, the apparatus may comprise a tubular body defining a longitudinal axis and cleaning elements symmetrically disposed around the longitudinal axis.

The body may comprise an opening corresponding to each cleaning element.

The body may be a tubular body comprising a plurality of openings therethrough, and the apparatus may comprise a plurality of cleaning elements; the outer portion of each cleaning element being configured to at least partially extend through the openings and to extend outwards from an outer surface of the body, when in the extended positions.

The cleaning elements may be grouped, in one or more substantially longitudinal, radial or helical paths (extending along and/or around the body).

The cleaning elements are grouped to define a substantially continuous helical path. The helical path may define an active cleaning surface of at least 360 degrees.

The cleaning elements may define a plurality of helical paths. The helical paths may be arranged such that the circumferential extent of the combined helical paths is at least 360 degrees; i.e. defining an active cleaning surface of at least 360 degrees. For example, in an embodiment comprising three helical paths each path extends circumferentially by at least 120 degrees. The arrangement of the helical paths, as defined by the openings and cleaning elements, may define an active cleaning surface of at least 360 degrees.

Accordingly, the entire circumference of a wellbore may be cleaned by reciprocating motion of the cleaning apparatus along the longitudinal axis of the tubular body, or by means of a combination of reciprocation and rotation. Known devices use rotational motion combined with slow axial motion to clean the casing wall. Typically, a scraper is reciprocated three times over a given area to be cleaned. A typical scraper comprises three blades, each blade measuring 228 mm (9 inches) long with a rotational speed of around 60 revolutions per minute. The longitudinal reciprocating velocity is typically a maximum of 0.23 m/s (45 ft/min). In contrast, a cleaning apparatus having an active cleaning surface of at least 360 degrees as disclosed herein can be reciprocated up to 0.76 m/s (150 ft/min), providing for a reduction in cleaning time and/or more effective cleaning.

The downhole cleaning apparatus may comprise a one or more longitudinal or helical flutes, the/each flute being defined between longitudinal or helical ribs.

The longitudinal or helical paths defined by the cleaning elements may run along the ribs.

The openings may be provided on the ribs.

The openings may be provided by a plurality of slots, wherein at least a corresponding number of cleaning elements are provided wherein one or more cleaning elements extend through each slot.

The cleaning apparatus may comprise at least three ribs defined by three flutes.

A cleaning element may comprise one or more scraper blades. A cleaning element may be a brush. The cleaning apparatus may comprise more than one type of cleaning element. For example, some may be scraper blades, some may be a brush. Indeed, a cleaning apparatus may comprise cleaning elements adapted (for example by way of the orientation of scraper blades) to most effectively clean when the apparatus is rotated and/or cleaning elements adapted to most effectively clean when the apparatus is longitudinally reciprocated.

The downhole apparatus may be connectable to a drilling tool or drill string. The downhole cleaning apparatus may be connectable above a drill bit of a drilling tool in a downhole application. The downhole cleaning apparatus may further comprise male or female connections arranged to connect each end of the tubular body to a drilling element.

According to a second aspect of the invention there is provided a method of cleaning an inside of a wellbore, the method comprising:

providing a cleaning apparatus having a body and a cleaning element coupled to the body; the cleaning element having an inner portion comprising a first retention formation and an outer portion comprising a cleaning formation; running the cleaning apparatus into the wellbore with the cleaning element in a retracted position;

operating an actuation system to cause a second retention formation to slide from a retaining position in which the second retention formation is coupled to the first retaining formation, to a release position in which the first and second retaining formations are released from one another;

then moving the cleaning element from the retracted position to an extended position.

The method may comprise cleaning the inside of the wellbore using the cleaning element by moving the cleaning apparatus in relation to the wellbore. The apparatus may for example be reciprocated (longitudinally and/or rotationally), rotated and/or translated along the wellbore in order to effect cleaning.

The cleaning apparatus may be a cleaning apparatus of the first aspect.

The method may further comprise, prior to installing the downhole apparatus in into the wellbore casing, the step of attaching the downhole cleaning apparatus to a work string and thereby installing the downhole cleaning apparatus together with the work string. The work string may be a drill string.

The method may further comprise the step of moving the cleaning element from the extended position to the retracted position.

Moving the cleaning element from the retracted position to the extended position and, in some embodiments, from the extended position to the retracted position may comprise operating the actuation system.

Moving the cleaning element may comprise changing the fluid pressure in the body. For example, moving the cleaning elements from the retracted position to the extended position may comprise increasing the fluid pressure. In some embodiments, the method may comprise blocking a through bore through the body (e.g. using a ball or a dart). In some embodiments, when the through bore is blocked, increasing pressure so as to move the second retention formation and/or to break a shear element, such as a pin or ring.

The method may comprise compressing the cleaning apparatus, for example by applying longitudinal force via a work string, to perform a stage of operating the actuation system. For example, the cleaning apparatus may be compressed in order to move the second retention formation (or to break a shear element in order to allow such movement).

The method may comprise moving more than one cleaning element (typically simultaneously).

Cleaning the inside of the wellbore may comprise circulating fluid in the wellbore. The body may have a through bore and the method may comprise flowing fluid through the body, for example during cleaning.

The method may further comprise withdrawing the downhole cleaning apparatus from the wellbore. The cleaning element or elements may be moved from the extended to retracted position before or after removal from the wellbore.

The method may comprise further such steps as required in order to operate the cleaning apparatus of the first aspect, as disclosed above.

The invention extends in further aspects to component parts of the cleaning apparatus, such as a cleaning element comprising one or more said first retention formations.

It will be understood that preferred and optional features of each aspect of the invention correspond to preferred and optional features of any other aspect of the invention.

DESCRIPTION OF THE DRAWINGS

Non-limiting examples of the invention are described below, with reference to the accompanying drawings, in which.

DETAILED DESCRIPTION OF EXAMPLE EMBODIMENTS

Figure 1:
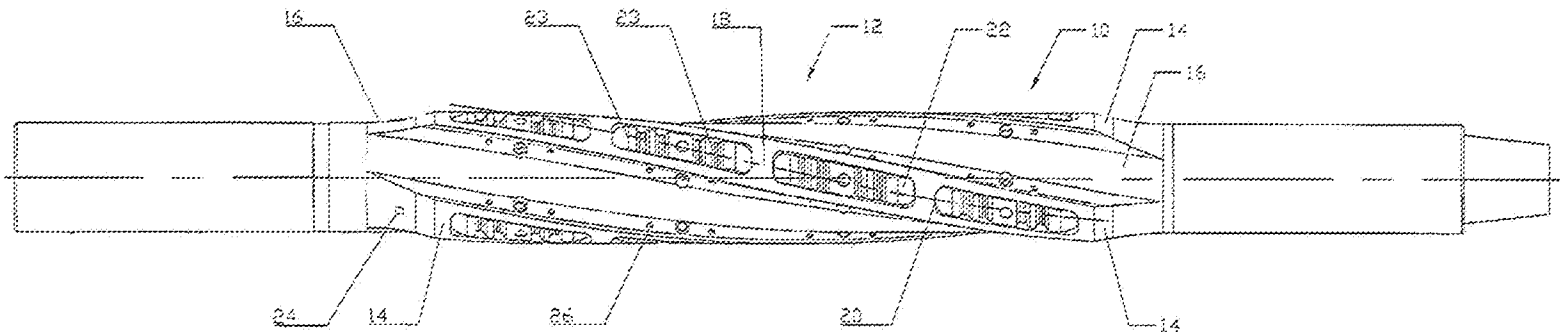
FIG. 1 is a schematic representation of a downhole cleaning apparatus with cleaning elements in retracted positions.
Figure 2:
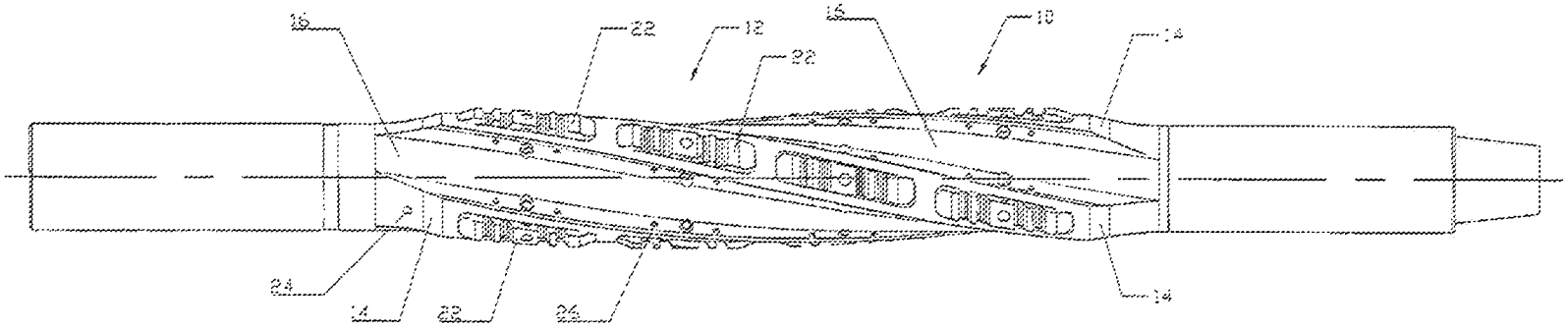
FIG. 2 is a schematic representation of the downhole cleaning apparatus with the cleaning elements in extended positions.

FIGS. 1 and 2, each show a casing cleaner 10 (a downhole cleaning apparatus), which represents a downhole cleaning apparatus. The casing cleaner 10 includes a tubular body 12, which comprises an axial through bore (not visible in FIG. 1 or 2). The casing cleaner 10, in the illustrated embodiment, includes three external ribs 14. Flutes 16 (two of which can be seen in FIGS. 1 and 2) separate the ribs 14 and define zones via which debris dislodged from the casing wall (not illustrated) can be discharged in use.

The ribs 14 and flutes 16 of the illustrated embodiment each define part of a helix 18 which extends end to end on the external surface of the body 12.

Each rib 14 includes slots 20 through which cleaning elements 22 extend. As shown in the cross-sectional views of FIGS. 3 to 6 the cleaning elements 22 coupled to the body 12, to prevent them from being fully expelled from the tubular body 12, by locking pins 38 that are attached to the body and extend into the slots 20 and into a groove 40 provided in the side of each cleaning element 22. The grooves are oriented radially in relation to the longitudinal axis A of the body 12. The range of movement of the cleaning element 22 is thereby limited by the length of the groove 40.

The slots 20 and cleaning elements 22 each define part of the helix 18 defined by the ribs 14 and flutes 16. In the illustrated embodiment each of the helical ribs 14 includes four slots 20 and four cleaning elements 22.

In alternative embodiments (not shown) the casing cleaner may have a different number of flutes or ribs, a longitudinal (rather than helical) array of cleaning elements, or any number of one or more cleaning elements.

In respect of the casing cleaner 10, as illustrated, the circumferential extent of each helix 18 is at least 120 degrees such that, in use, the cleaning elements 22 are operable to be in contact with the entire 360 degree casing surface. The arrangement of the ribs 14 and cleaning elements 22 in the form of a helix means that, in use, the casing cleaner 10 needs only to be operated in a reciprocating manner.

The cleaning elements 22 in the illustrated embodiment have an outer portion (indicated generally as 22*a*) which includes scraper blades 23 (a cleaning formation). Scraper blades comprise a plurality of cutting edges that act against the casing wall to dislodge debris as the cleaner passes through the casing. Casing scrapers may be constructed from, for example, machined low alloy steel. Alternatively, the blades may be forged. The material choice and construction of the blades is that which demonstrates long lasting durability and excellent scraping characteristics. Alternatively, the cleaning elements may comprise another type of cleaning formation, such as brushes, which can be used to brush and clean the interior surface/circumference of a casing to remove scale, rust, mud residue and other types of debris. The scraper blades and brushes are configured to act in an abrasive manner to clean the casing wall.

The cleaning elements 22 are arranged to be retained in a retracted position (shown in FIG. 1), when the casing cleaning 10 is run in. In the retracted position, the cleaning elements are recessed in relation to the outer surface of the body, to prevent wear of the scraper blades or casing during run in.

The cleaning elements 22 are selectively moveable in relation to the body 12 from the retracted position shown in FIG. 1 to an extended position shown in FIG. 2. In the extended position, the scraper blades extend radially from the outermost surface of the body and so can be used to clean a casing.

As discussed in further detail below, the cleaning elements 22 are biased outwardly by springs 50 positioned at their outer ends in cavities 52 in the inner face of the cleaning elements and at their inner ends in tapered cavities 36 in the outer face of a setting sleeve 32. In alternatively embodiments, the cleaning elements are not biased outwardly, until the springs 50 slide out of the tapered cavities 36 in the manner discussed below.

The tapered cavities are optional and in other embodiments (not shown) the sleeve has a constant outer diameter in the region that interacts with the springs in use.

The casing cleaner 10 can be sized such that the overall maximum diameter across the extended cleaning elements exceeds the diameter of the casing to be cleaned, such that the blades are biased with a biasing force F1 into contact with the inner wall of the casing.

The casing cleaner 10 includes an actuation system, the structure and operation of which is described with reference to FIGS. 3 to 6.

Figure 3:
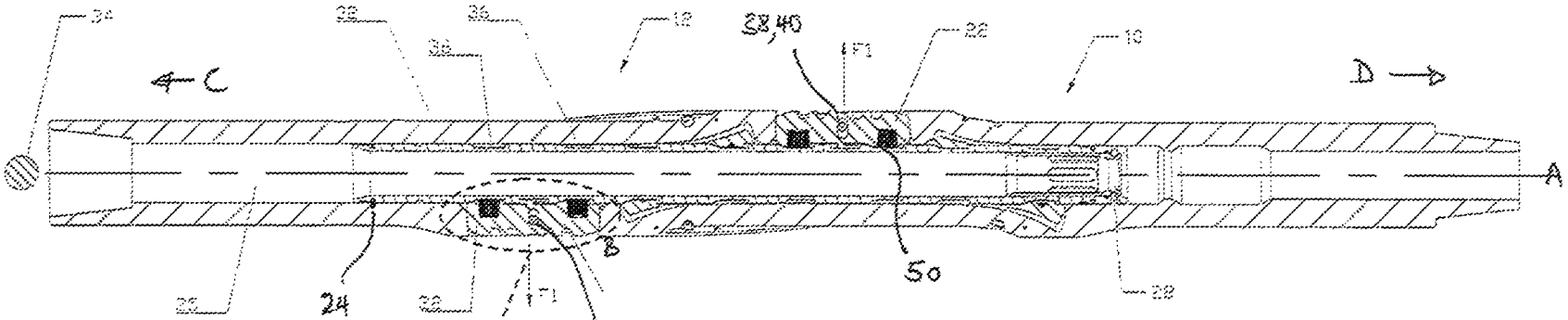
FIG. 3 is a schematic representation of an axial cross-section of the downhole cleaning apparatus as illustrated in FIG. 1.
Figure 4:
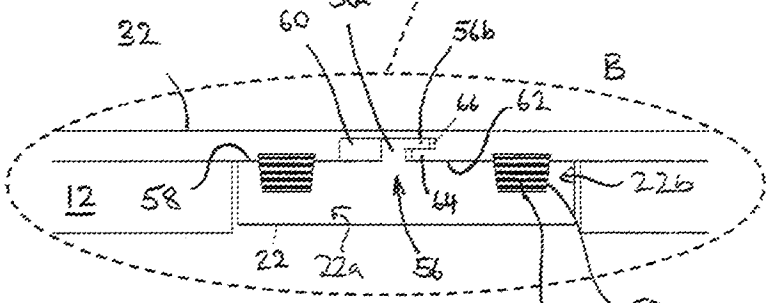
FIG. 4 is an expanded, simplified cross sectional view of region B of FIG. 3.

FIG. 3 shows a schematic cross sectional view of the tool 10, with the cleaning elements 22 in their retracted positions (c.f. FIG. 1). The expanded section B of FIG. 4 shows a simplified schematic cross sectional view of the cleaning element and the adjacent parts of the tool 10.

In the illustrated embodiment, the cleaning elements 22 are biased by spring force F1 applied between the sleeve 32 and the cleaning elements 22 radially outwardly towards the extended position. The cleaning elements have an inner portion 22*b* which includes a first retention formation, in the form of a protrusion 56.

The cleaning elements 22, are held in the retracted position by a protrusion 56 that extends from the inner face 58 of each cleaning element (an example of a first retention formation), that is received within a recess 60 (an example of a second retention formation) in the outer face 62 of a setting sleeve 32 that is positioned with the axial through bore 35 of the tool 10. The first and second retention formations 58, 60 are thus coupled together.

The protrusion 56 is L-shaped in cross section along the axis A, and comprises a radially extending portion 56*a* and a longitudinally extending portion 56*b*. The recess has a wide entranceway that extends longitudinally slightly further that the longitudinal extent of the protrusion 56.

A lip 64 extends partially over the recess 60, to define an enclosed region 66. Accordingly, the longitudinally extending portion 56*b* of the protrusion 56 is received within the enclosed region 64 of the recess, thereby coupling the first and second retaining formations, and is prevented by the lip from being propelled radially outward.

As discussed in further detail below, the setting sleeve 32 is slideable in relation to the body. Thus, the recess 60 is longitudinally slideable in relation to the body the body 12, between the retaining position shown in FIGS. 3 and 4, and the release position shown in FIGS. 5 and 6.

Movement of the second retaining formation, the recess 60, from the retaining position to the release position moves the longitudinal portion 56*b* clear of the lip 64 and thereby release the first and second retaining formations 56, 60 from one another and allow the cleaning element to move to its extended position.

The first and second retaining formations, the protrusion 56 and the recess 60, form part of an actuation system, operable to selectively move the cleaning element from the retracted position to the extended position. A shear pin 24 acts to restrain the setting sleeve 32 from moving longitudinally within the axial through bore 35.

A ball seat 30 is positioned in the bore 35 at the distal end of the body 12, and connected to the sleeve 32. To selectively more the cleaning elements 22 to the extended positions, the axial bore 35 is sealed by release of a ball 34, that is either pumped down from the surface or allowed to drop freely. The ball 34 comes to rest on the ball seat 30 such that fluid pressure within the axial bore 35 can increase to the predetermined level in which pins 24 shear or break to release the setting sleeve 32 which will begin to move downwards (in the direction D).

Figure 5:
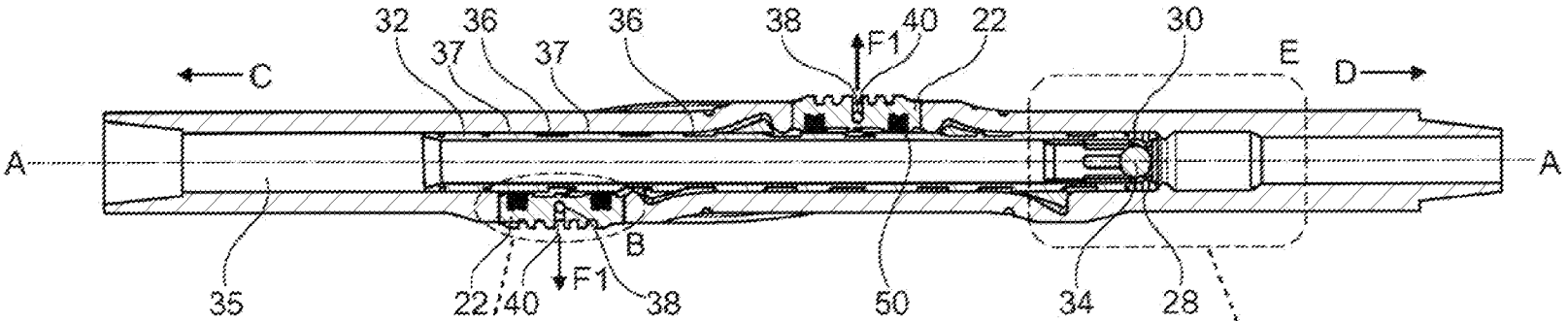
FIG. 5 is a schematic representation of an axial cross section of the downhole cleaning apparatus as illustrated in FIG. 2.
Figure 6:
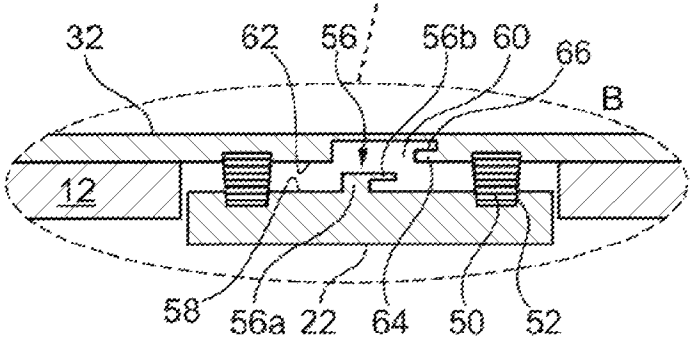
FIG. 6 is an expanded, simplified cross sectional view of region B of FIG. 5.

The sleeve and thus also the recesses 60 thereby slide to the position shown in FIGS. 5 and 6, in which the longitudinal portion 56*b* is clear of the lip 64. The first and second retaining formations have thereby been slideably released from one another and the cleaning elements are able to move radially outward to their extended positions under the action of the springs 50.

The retaining formations are located internally to the tool (i.e. the inner portion 22*a* of the cleaning element 22 and the adjacent parts of the actuation system), and so are not exposed to the wellbore in use.

As the setting sleeve 32 moves in the direction D, the inner ends of the springs 50 slide out of the tapered cavities 36 on to wider diameter portions 37 of the sleeve 32, so as to increase the effectiveness of the springs 50.

In some examples, when the springs sit in the tapered cavities and the cleaning elements are in their retracted positions, the springs are not compressed. In this case, the spring bias is provided as the springs ride up and out of the cavities 36.

In still further examples (not shown) the sleeve may, at least when moved to its most distal position, be rotatable so as to cause the springs to ride up and out of the tapered cavities. In this case longitudinal motion of the sleeve primes the cleaning elements for extension, and rotation causes the extension to occur. Internal fluid pressure in the bore can also be used to extend the cleaning elements in some cases.

In other examples, the body itself is compressible and be formed from two portions. The the sleeve may abut or be connected to one of the portions, such that compression of the body causes the slideable disengagement of the first and second retaining formations generally as described above.

At this stage the cleaning elements 22 are extended and ready to clean the casing.

For some applications it may be desirable for fluid flow through the bore 35 to be restored during cleaning, for example to pump fluid through the bore and create allow a fluid back flow within the casing to wash cuttings away from the cutting elements 22 in use.

Figure 7:
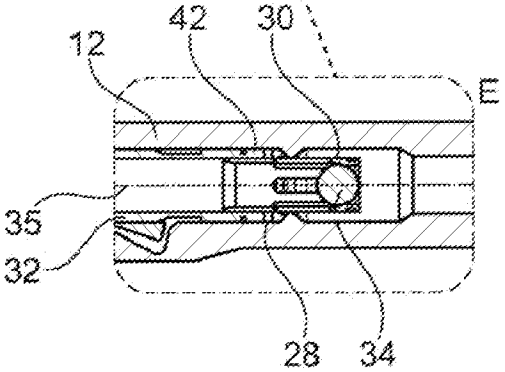
FIG. 7 is a view of region E of FIG. 6, with the through bore re-opened for fluid flow.

Referring to FIG. 7, by raising fluid pressure within the axial bore 34 to a predetermined level the shear pins 28, which are located at the ball seat 30 are sheared and a ball seat sleeve 42 is released and moved downwards (direction D) by a distance sufficient to allow fluid flow F2 through the axial bore 35. Alternatively, the ball and/or ball seat may be deformable, so that by further increasing the pressure within the bore, the ball is forced through the ball seat and into the well.

Cleaning the casing with a casing cleaner 10 according to the embodiments described above may be by axial reciprocating motion only where the casing cleaner 10 need only be moved upwards (to the left in the illustrated embodiment) and downwards (to the right in the illustrated embodiment) to remove debris from the inner casing wall. Any debris is expelled via the flutes.

The configuration of the casing cleaner 10 according to embodiments of the present invention is such that reciprocation combined with rotation of the casing cleaner 10 is effective in removing debris from the casing wall quickly and efficiently.

Figure 8:
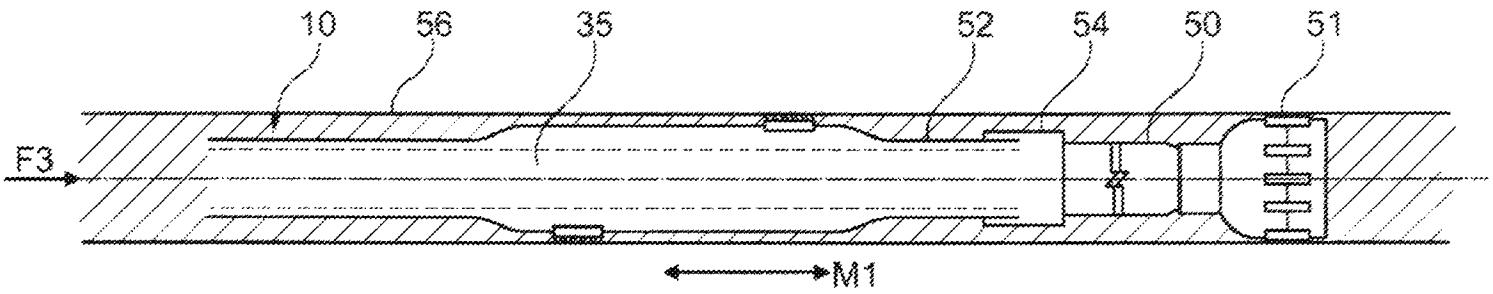
FIG. 8 is a schematic representation of an assembly of a casing cleaner.

As shown in FIG. 8, the casing cleaner 10 is attached to a drill string 50 by suitable male or female mechanical connections 52, 54. The connections 52, 54 are suitable for attachment to a drill string 50, as shown in FIG. 8.

The casing cleaner 10 is attached to the upper side of the drill string 50 comprising a drill bit 51. The assembly of drill string 50 and casing cleaner 10 is then run into the casing 56 in a known manner. The cleaning elements 10 are retracted into the tubular body for run-in and extended for cleaning.

The drill string 50 is used in a known manner to drill a hole, for example a new wellbore. This may involve drilling, using a suitable drill bit 51, through the base of an existing casing 56 in which the drill string 50 is run-in and creating a new bore in the direction of a drilling target zone.

When the drilling step is complete the cleaning operation can be initiated by extending the cleaning elements as described above. When cleaning is complete the method also includes retrieval of the casing cleaner 10 at surface as the drill string 50 is removed from the casing 56. After use the cleaning elements can be forced back to their retracted positions, for example during redressing or inspection/refit of the tool 10, and the setting sleeve can be re-set and replacement shear pins applied, thereby returning the recess to the retaining positon for re-use.

Figure 9:
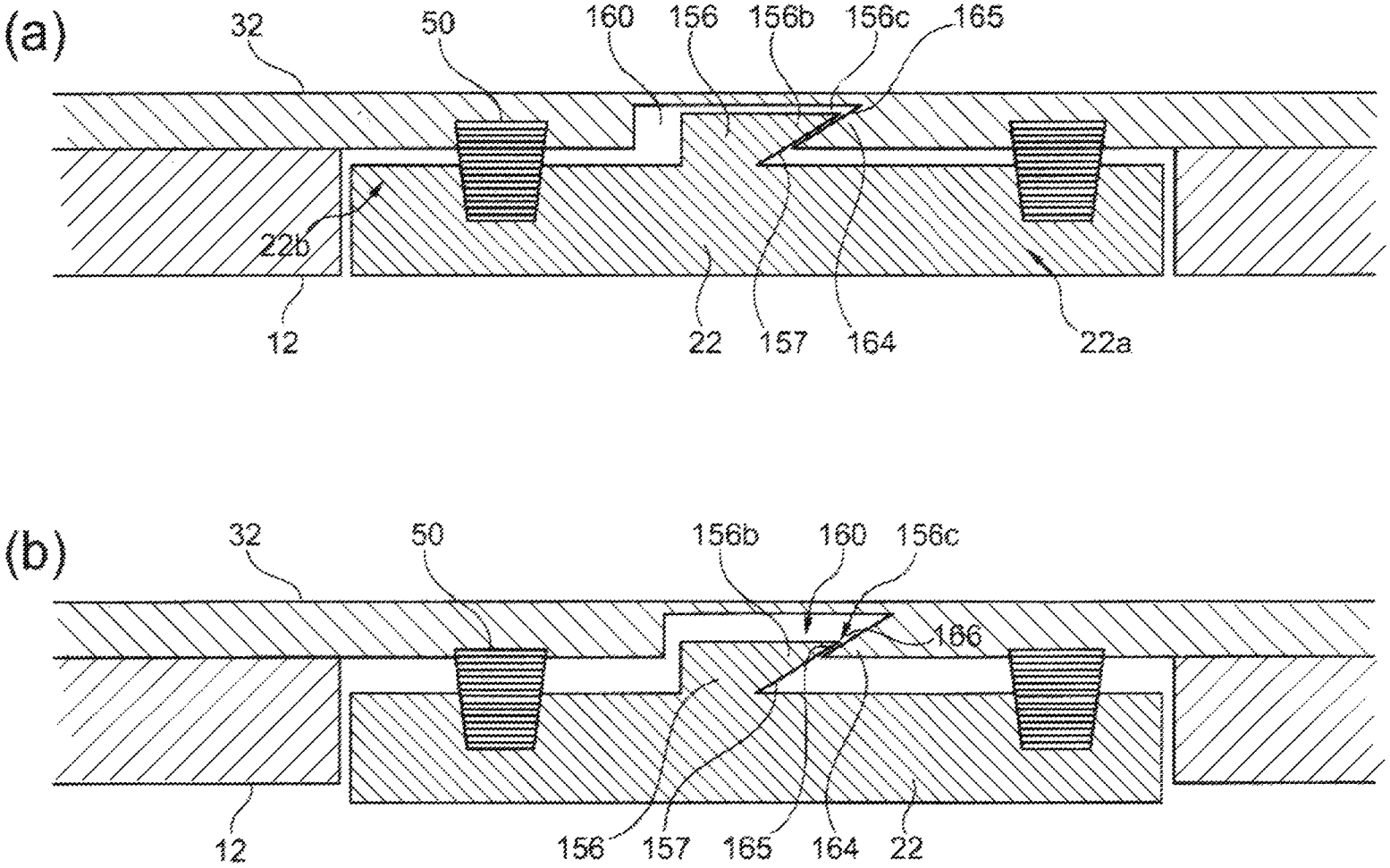
FIG. 9 is an expanded, simplified cross sectional view of region B of an alternative example of a downhole cleaning apparatus (a) with the cleaning element in a retracted position and (b) with the cleaning element in an extended position.

FIGS. 9*a* and 9*b* show region B an alternative embodiment of an actuation system for a cleaning apparatus, with reference numerals in common with the embodiment of FIG. 6 provided with like reference numerals, incremented by 100.

The associated tool comprises a setting sleeve 32 that is biased by annular springs (not shown) that act between the body and the sleeve to urge the sleeve towards the direction C. As previously shear pin 24 acts to restrain the setting sleeve 32 from moving longitudinally within the axial through bore 35.

In this embodiment, the sleeve 32 is provided with a recess 160. A lip 164 extends part way across the recess to define an enclosed region 166. The radially inward surface 165 of the lip 164 is tapered.

The cleaning element 22 is provided with a protrusion 156. The protrusion 156 has a longitudinally extending portion 156*b* having a tapered radially outward surface 157.

The tapered surfaces 165 and 157 are slideable in relation to one another, as the second retention formation moves between the retaining position shown in FIG. 9*a* and the release position shown in FIG. 9*b*. The cleaning element is urged outwardly by the springs 50 to their extended positions. In this case, however, the tip 156*c* of the protrusion remains under the lip 164 when the cleaning element 22 is fully extended.

This enables the cleaning elements to be selectively moved from their extended positions (FIG. 9*b*) to their retracted positions (FIG. 9*a*) downhole. Reduction of the pressure in the wellbore can be effected by cessation of pumping at the surface, by shearing shear pins 28 as described above, or re-opening the bore by forcing the ball 34 through the ball seat 30 as described above. The spring biased setting sleeve 32 then moves back towards the direction C, and the second retaining formation (recess 160) moves back towards the retracted position. Advantageously, the springs 50 slide back into the tapered cavities 36 during this process to reduce or remove the outward bias applied by the springs 50, such that the cleaning elements are effectively locked in place by the spring bias applied to the sleeve 32.

Whilst specific embodiments of the present invention have been described above, it will be appreciated that departures from the described embodiments may still fall within the scope of the present invention.

The invention claimed is:

1. A downhole cleaning apparatus, comprising:

a body and a cleaning element coupled to the body;

the cleaning element selectively moveable in relation to the body from a retracted position to an extended position; and the cleaning element having an inner portion comprising a first retention formation and an outer portion comprising a cleaning formation; and an actuation system comprising a second retention formation slideable in relation to the body between a retaining position and a release position;

wherein, in the retracted position, the first retention formation is coupled to the second retention formation and wherein the first and second formations together function as a latch, to latch the cleaning element in the retracted position;

the first and second retention formations being slideably releasable from one another by sliding the second retention formation from the retaining position to the release position, in which the cleaning element is able to move to the extended position.

2. The cleaning apparatus of claim 1, wherein the second retention formation is longitudinally slideable along an axis, wherein such longitudinal motion slideably moves the second retention formation in relation to the first retention formation, between the retaining and release positions.

3. The cleaning apparatus of claim 1, wherein the second retention formation is biased towards the retaining position.

4. The cleaning apparatus of claim 3, wherein the second retention formation is biased towards the retaining position by a resilient biasing arrangement which acts between the body and the second retention formation.

5. The cleaning apparatus of claim 1, wherein one of the first retention formation or the second retention formation comprises a protrusion and the other of the first retention formation or the second retention formation comprises a recess or aperture sized to receive at least a part of the protrusion.

6. The cleaning apparatus of claim 5, wherein the first retention element comprises the protrusion and the second retention formation comprises the recess or aperture.

7. The cleaning apparatus of claim 5, wherein the protrusion is L-shaped in cross section, taken along a direction of motion between the retaining and release positions.

8. The cleaning apparatus of claim 1, further comprising a setting sleeve, the sleeve slideable within the body; the sleeve comprising the second retention formation and being longitudinally slideable in relation to the body.

9. The cleaning apparatus of claim 8, wherein an outer surface of the setting sleeve comprises the second retention formation.

10. The cleaning apparatus of claim 1, wherein the cleaning element is biased towards the extended position.

11. The cleaning apparatus of claim 1, wherein the actuation system further comprises:

a ball and/or a dart; and a seat to receive a said ball or dart and thereby at least partially block a through bore through the body to facilitate an increase of internal pressure within the body, the increase in pressure causing the second retention formation to move from the retaining position to the release position.

12. The cleaning apparatus of claim 1, wherein the cleaning formation comprises a cutting profile or a brush operable, in use, by axial reciprocation to remove debris from a surface in which the cleaning elements are in contact.

13. The cleaning apparatus of claim 1, wherein the body is a tubular body defining a longitudinal axis and a plurality of cleaning elements, wherein the plurality of cleaning elements are symmetrically disposed around the longitudinal axis.

14. The cleaning apparatus according to claim 1, wherein the body is a tubular body defining a longitudinal axis and a plurality of cleaning elements, wherein the body comprises an opening corresponding to each cleaning element, wherein the outer portion of each cleaning element is configured to at least partially extend through the openings and to extend outwards from an outer surface of the body, when in their extended positions.

15. The cleaning apparatus of claim 14, comprising a one or more longitudinal or helical flutes, the/each flute being defined between longitudinal or helical ribs, wherein longitudinal or helical paths defined by the cleaning elements run along the ribs.

16. A method of cleaning an inside of a wellbore, comprising the steps of:

providing a cleaning apparatus having a body and a cleaning element coupled to the body; the cleaning element having an inner portion comprising a first retention formation and an outer portion comprising a cleaning formation;

the cleaning apparatus further comprising an actuation system comprising a second retention formation;

wherein the second retention formation is in a retaining position in which the first and second retention formations are coupled together and function as a latch to mechanically latch the cleaning element in a retracted position;

running the cleaning apparatus into the wellbore;

operating the actuation system to cause the second retention formation to slide from the retaining position to a release position in which the first and second retaining formations are released from one another;

then moving the cleaning element from the retracted position to an extended position.

17. The method of claim 16, comprising cleaning the inside of the wellbore using the cleaning element, by moving the cleaning apparatus in relation to the wellbore and flowing fluid through a through bore through the body.

18. The method of claim 16, comprising changing the fluid pressure in the body and one or more of;

moving the cleaning elements from the retracted position to the extended position by increasing the fluid pressure;

blocking a through bore through the body and increasing pressure so as to move the second retention formation and/or to break a shear pin.

19. A downhole cleaning apparatus, comprising:

a body and a cleaning element coupled to the body;

the cleaning element selectively moveable in relation to the body from a retracted position to an extended position; and the cleaning element having an inner portion comprising a first retention formation and an outer portion comprising a cleaning formation; and an actuation system comprising a second retention formation slideable in relation to the body between a retaining position and a release position;

wherein one of the first retention formation or the second retention formation comprising a protrusion that is L-shaped in cross section, taken along a direction of motion between the retaining and release positions, and the other of the first retention formation or the second retention formation comprises a recess or aperture sized to receive at least a part of the protrusion;

wherein, in the retracted position, the first retention formation is coupled to the second retention formation;

the first and second retention formations being slideably releasable from one another by sliding the second retention formation from the retaining position to the release position, in which the cleaning element is able to move to the extended position.

20. The cleaning apparatus of claim 19, further comprising:

a setting sleeve slideable within the body, wherein the sleeve comprises the second retention formation and is longitudinally slideable in relation to the body.

21. A downhole cleaning apparatus, comprising:

a body and a cleaning element coupled to the body;

the cleaning element selectively moveable in relation to the body from a retracted position to an extended position; and the cleaning element having an inner portion comprising a first retention formation and an outer portion comprising a cleaning formation; and an actuation system comprising a second retention formation slideable in relation to the body between a retaining position and a release position;

wherein, in the retracted position, the first retention formation is coupled to the second retention formation and wherein the first and second formations together function as a latch, to latch the cleaning element in the retracted position;

the first and second retention formations being slideably releasable from one another by sliding the second retention formation from the retaining position to the release position, in which the cleaning element is able to move to the extended position, wherein the body is a tubular body defining a longitudinal axis and a plurality of cleaning elements, wherein the body comprises an opening corresponding to each cleaning element, wherein the outer portion of each cleaning element is configured to at least partially extend through the openings and to extend outwards from an outer surface of the body, when in their extended positions, and comprising a one or more longitudinal or helical flutes, having each flute being defined between longitudinal or helical ribs, wherein longitudinal or helical paths defined by the cleaning elements run along the ribs.

* * * * *